US008145090B2

(12) United States Patent
Tanase

(10) Patent No.: US 8,145,090 B2
(45) Date of Patent: Mar. 27, 2012

(54) CLEANING DEVICE OF WIRE, CHARGING DEVICE USING THE SAME AND IMAGE FORMING APPARATUS

(75) Inventor: Masami Tanase, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 416 days.

(21) Appl. No.: 12/481,022

(22) Filed: Jun. 9, 2009

(65) Prior Publication Data

US 2010/0104317 A1 Apr. 29, 2010

(30) Foreign Application Priority Data

Oct. 27, 2008 (JP) ..... P2008-276160

(51) Int. Cl.
*G03G 15/02* (2006.01)

(52) U.S. Cl. ..... 399/100

(58) Field of Classification Search ..... 399/100; 15/220.4, 256.6
See application file for complete search history.

(56) References Cited

U.S. PATENT DOCUMENTS

| | | | | |
|---|---|---|---|---|
| 2,239,159 | A * | 4/1941 | Miller | 15/220.4 |
| 5,012,093 | A * | 4/1991 | Shimizu | 399/100 |
| 5,687,054 | A | 11/1997 | Takada et al. | |
| 5,704,088 | A * | 1/1998 | Cerroni | 15/160 |
| 5,735,013 | A * | 4/1998 | Yaguchi et al. | 15/210.1 |
| 2004/0062565 | A1* | 4/2004 | Itabashi | 399/100 |
| 2008/0159776 | A1* | 7/2008 | Tanase | 399/100 |

FOREIGN PATENT DOCUMENTS

| | | |
|---|---|---|
| JP | 2-62565 | 3/1990 |
| JP | 2-118586 | 5/1990 |
| JP | 9-244357 | 9/1997 |
| JP | 11-24375 | 1/1999 |
| JP | 11-258891 | 9/1999 |
| JP | 2006-126659 | 5/2006 |

* cited by examiner

*Primary Examiner* — David Gray
*Assistant Examiner* — G. M. Hyder
(74) *Attorney, Agent, or Firm* — Morgan, Lewis & Bockius LLP

(57) ABSTRACT

A cleaning device of a wire includes: a first cleaning member that cleans a wire when the first cleaning member comes into contact with the wire; a second cleaning member that wipes off the wire when the second cleaning member comes into contact with the first cleaning member while the wire is being interposed between the first and the second cleaning member; and a holding and moving body that holds and reciprocates the first and the second cleaning members in a direction in which the wire is stretched. The second cleaning member is contacted with the wire at a protruding portion in which the second cleaning member protrudes from a rear end portion of the first cleaning member in the direction at least at the time of a going-back movement of the first cleaning member.

9 Claims, 15 Drawing Sheets

CLEANING DEVICE OF WIRE, CHARGING DEVICE USING THE SAME AND IMAGE FORMING APPARATUS

CROSS-REFERENCE TO RELATED APPLICATIONS

This application is based on and claims priority under 35 USC 119 from Japanese Patent Application No. 2008-276160 filed Oct. 27, 2008.

BACKGROUND

1. Technical Field

The present invention relates to a cleaning device of a wire, a charging device in which the cleaning device is used and an image forming apparatus.

2. Related Art

Concerning the cleaning device for cleaning a wire in a charging device in which corona discharge is used and also concerning the device in which the cleaning device is used, are known.

SUMMARY

According to an aspect of the invention, a cleaning device of a wire includes: a first cleaning member that cleans a wire when the first cleaning member comes into contact with the wire; a second cleaning member that wipes off the wire when the second cleaning member comes into contact with the first cleaning member while the wire is being interposed between the first and the second cleaning member; and a holding and moving body that holds and reciprocates the first and the second cleaning members in a direction in which the wire is stretched. The second cleaning member is contacted with the wire at a protruding portion in which the second cleaning member protrudes from a rear end portion of the first cleaning member in the direction at least at the time of a going-back movement of the first cleaning member.

BRIEF DESCRIPTION OF THE DRAWINGS

Exemplary embodiment(s) of the present invention will be described in detail based on the following figures, wherein.

DETAILED DESCRIPTION

An exemplary embodiment of the invention will be explained below referring to the accompanying drawings.

First Exemplary Embodiment

Figure 1:
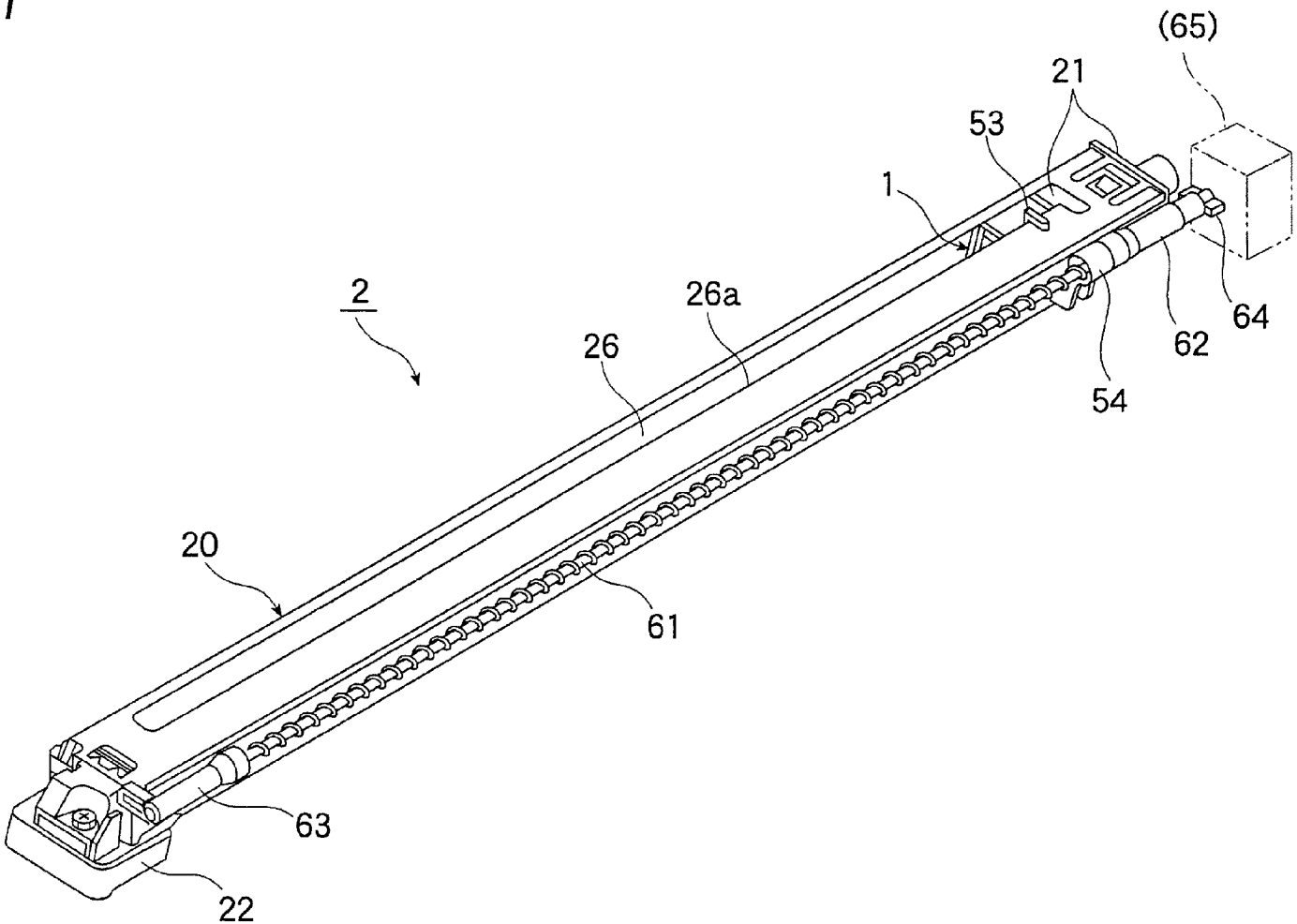
FIG. 1 is a perspective view showing a primary portion of a charging device in which a cleaning device of the first exemplary embodiment is used.
Figure 2:
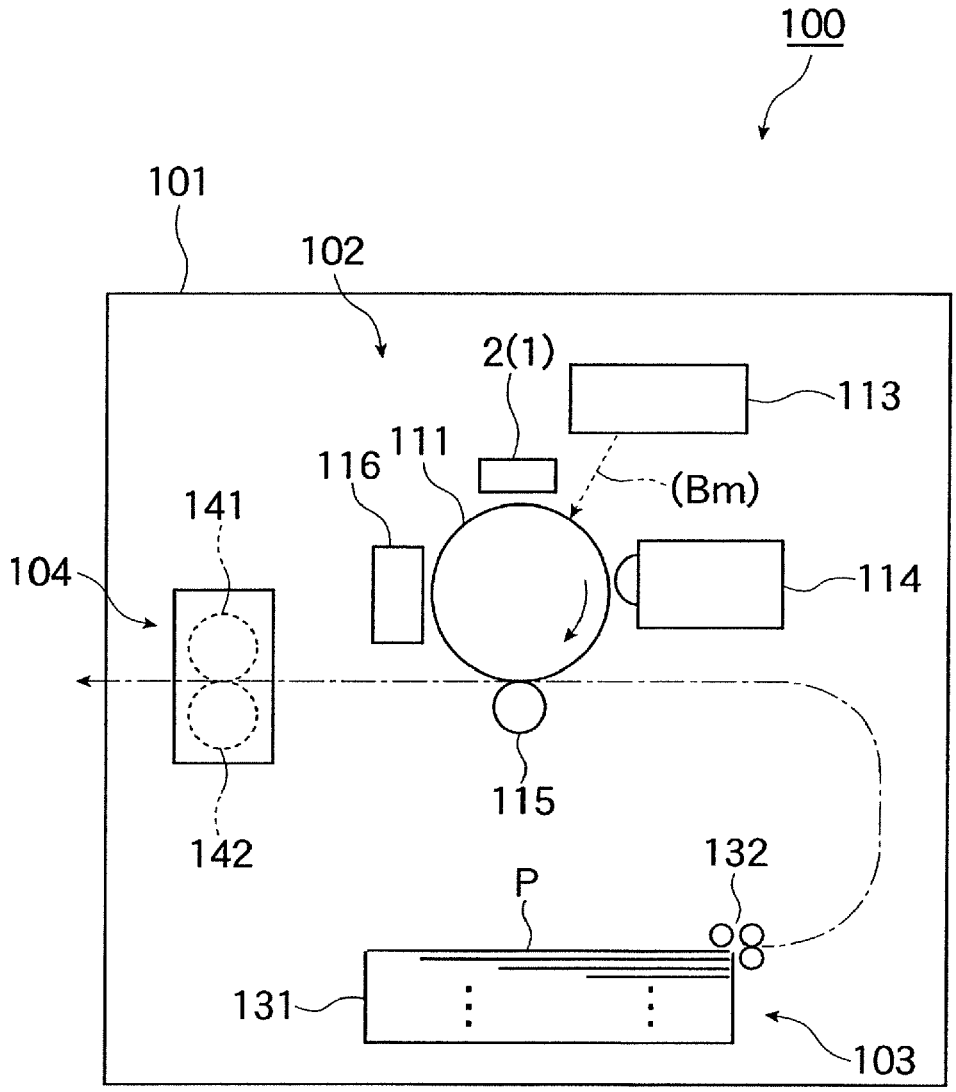
FIG. 2 is a schematic illustration showing a primary portion of an image forming apparatus in which the charging device shown in FIG. 1 is used.

FIGS. 1 and 2 are views showing a charging device and an image forming apparatus in which a cleaning device of cleaning a wire of the first exemplary embodiment is used. FIG. 1 shows a primary portion of the charging device 2 in which the cleaning device 1 is used and FIG. 2 shows a primary portion of the image forming apparatus 100 in which the charging device 2 is used.

As shown in FIG. 2, the image forming apparatus 100 includes: an image forming unit 102 for forming a toner image out of toner, which is a developer, in an inner space of the housing 101 having a supporting frame, an outer cover and others and for transferring the toner image onto a sheet of paper P; a sheet feeding device 103 for accommodating the sh exemplary embodiment, only one image forming unit 102 is provided as an example. However, it is possible to use a plurality of image forming units in the exemplary embodiment.

Figure 3:
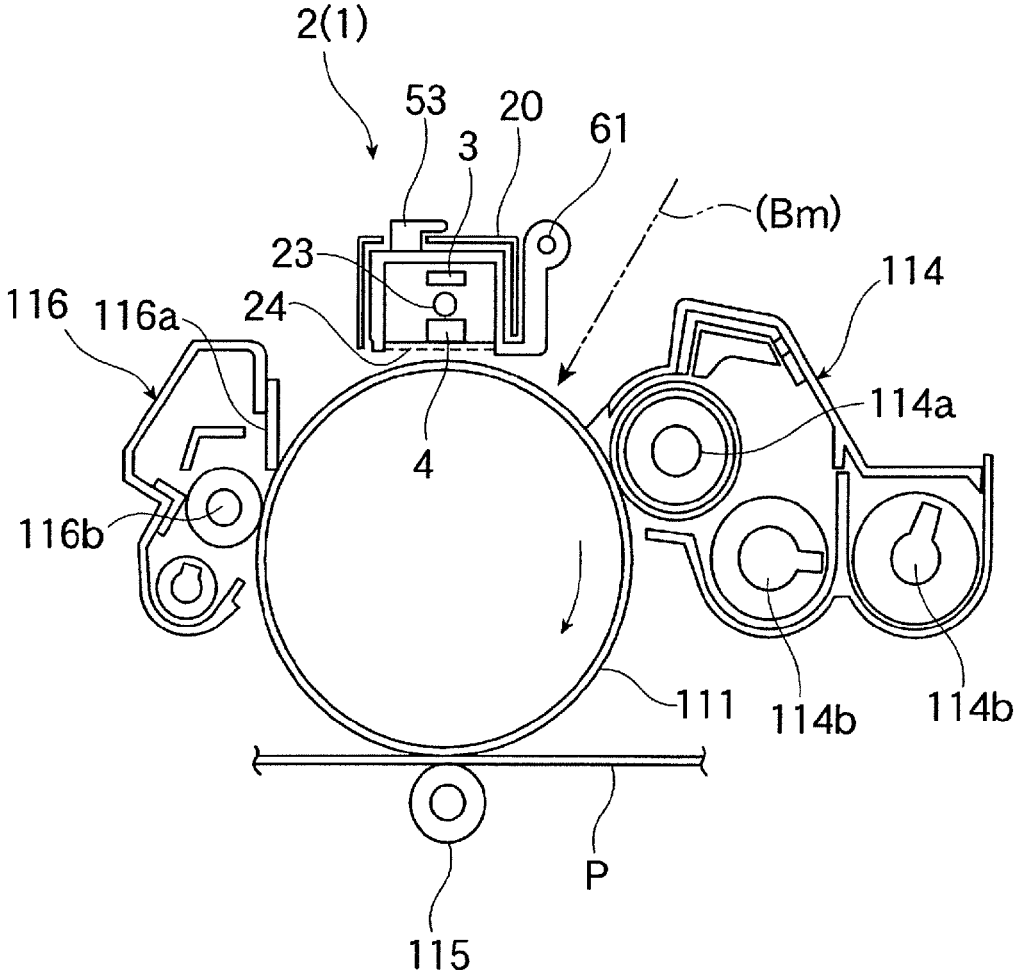
FIG. 3 is a sectional schematic illustration showing an image forming unit in the image forming apparatus shown in FIG. 2.

The image forming unit 1eets of paper P to be supplied to the image forming unit 102 and for conveying the sheets of paper P; and a fixing device 104 for fixing the toner image, which has been formed by the image forming unit 102, onto the sheet of paper P. In this 02 described above is composed by using, for example, the well known electrophotographic system. As shown in FIGS. 2 and 3, the image forming unit 102 includes: a photoreceptor drum 111 driven and rotated in the direction indicated by the arrow (clockwise in the drawing); a charging device 2 for electrically charging a circumferential face, which is an image forming region on the photoreceptor drum 111, by a predetermined electric potential; an exposure device 113 for forming an electrostatic latent image having an electric potential difference when a beam of light (Bm) based on image information (signal) is irradiated onto a surface of the photoreceptor drum 111 which has been electrically charged; a developing device 114 for developing the electrostatic latent image into a toner image by using toner; a transfer device 115 for transferring the toner image onto a sheet of paper P; and a cleaning device 116 for removing toner remaining on the surface of the photoreceptor drum 111 after the completion of transfer.

The photoreceptor drum 111 is composed in such a manner that, for example, an optical dielectric layer made of organic photosensitive material is formed on an outer circumferential face of a cylindrical conductive base substance which is connected to the earth. The charging device 2 is a charger of the corona discharge type. The detail of this charging device 2 will be described later. The exposure device 113 executes an exposure operation according to the image information obtained when the image information, which is inputted from image generation sources such as a document reader connected to or provided in the image forming apparatus 100, an external connecting device and a storage medium reader, is processed by an image processing device not shown.

In the developing device 114, developer containing toner and carrier is used. While the developer is being stirred by the stirring and conveying member 114*b* rotated in an accommodating portion, the developer is conveyed so that it can be made to pass on the developing roller 114*a* and the developer is supplied into a developing region which is arranged being opposed to the photoreceptor drum 111. In the transfer device 115, the transfer roller is used which comes into contact with the photoreceptor drum 111, which is a charging member, and rotates. In the cleaning device 116, the cleaning blade 116*a* and the rotary brush 116*b* are contacted with a circumferential face of the photoreceptor drum 111. At the time of forming an image, voltage for charging, voltage for developing and voltage for transferring are respectively given from an electric power source not shown to the charging device 2 (the discharging wire), the developing device 114 (the developing roller 114*a*) and the transferring device 115 (the transfer roller).

The sheet feeding device 103 includes: a sheet accommodating body 131 of the tray or the cassette type in which a plurality of sheets of paper P, which are used for forming an image, the size and the type of which are predetermined, are accommodated being stacked; and a feeding device 132 for feeding the sheets of paper P, which are accommodated in the sheet accommodating body 131, one by one to a conveyance passage. When the time comes at which the sheets of paper P are fed, the sheets of paper P are fed one by one by the feeding device 132. According to the form of the use, a plurality of sheet accommodating bodies are provided. The one-dotted chain line attached with an arrow in FIG. 2 shows a main passage of the sheet of paper P. The conveyance passage includes: a plurality of pairs of sheet conveyance rollers; and a conveyance guide members.

The fixing device 104 includes: a heating rotary body 141 of the roller type or the belt type which is rotated in the arrowed direction and the surface temperature is heated and held at a predetermined temperature by a heating means; and a pressuring rotary body 142 of the roller type or the belt type which is contacted with the heating rotary body 141 in the axial direction by a predetermined contacting pressure so that the pressuring rotary body 142 can be rotated being driven. When the sheet of paper P, on which the toner image has been transferred, is made to pass through a fixing portion formed between the heating rotary body 141 and the pressuring rotary body 142, the toner image is fixed on the sheet of paper P.

This image forming apparatus 100 forms an image as follows. In this case, explanations are made into a basic image forming action executed when an image is formed on one side of the sheet of paper P.

When the image forming apparatus 100 receives a command of starting an image forming action, a circumferential face of the photoreceptor drum 111, which starts rotating, is electrically charged to a predetermined polarity and electric potential by the charging device 2 in a period of corona discharge. After that, a circumferential face of the photoreceptor drum 111, which has been electrically charged, is exposed by the exposure device 113 according to the image information. In this way, an electrostatic latent image composed by a predetermined electric potential difference is formed. Successively, when an electrostatic latent image formed on the photoreceptor drum 111 passes through the developing device 114, the electrostatic latent image is visualized as a toner image being developed by toner which is supplied from the developing roller 114*a* and electrically charged to be a predetermined polarity.

After that, when the toner image formed on the photoreceptor drum 111 is conveyed by the rotation of the photoreceptor drum 111 to a transfer position opposed to the transfer device 115, the toner image is transferred onto a sheet of paper P, which is fed by the sheet feeding device 103 through a conveyance passage, by the transfer device 115. After the transfer has been completed, the circumferential face of the photoreceptor drum 111 is cleaned by the cleaning device 116.

Successively, the sheet of paper P, onto which the toner image has been transferred, is separated from the photoreceptor drum 111 and conveyed so that it can be introduced into the fixing device 104. When the sheet of paper P passes through the fixing portion formed between the heating rotary body 141 and the pressuring rotary body 142 in the fixing device 104, the sheet of paper P is heated and pressured so that the toner image can be fixed. The sheet of paper P, onto which the toner image has already been fixed, is discharged from the fixing device 104 and conveyed to and accommodated in a discharged sheet accommodating portion not shown.

By the image forming operation described above, a monochromatic image is formed which is formed out of one color toner on one side of one sheet of paper P. In this way, the basic image forming action is completed. In the case where it is directed that an image forming action should be executed on a plurality of sheets of paper, the above series of actions are repeated by the times corresponding to the number of sheets of paper.

Next, the charging device 2 will be explained below.

Figure 4:
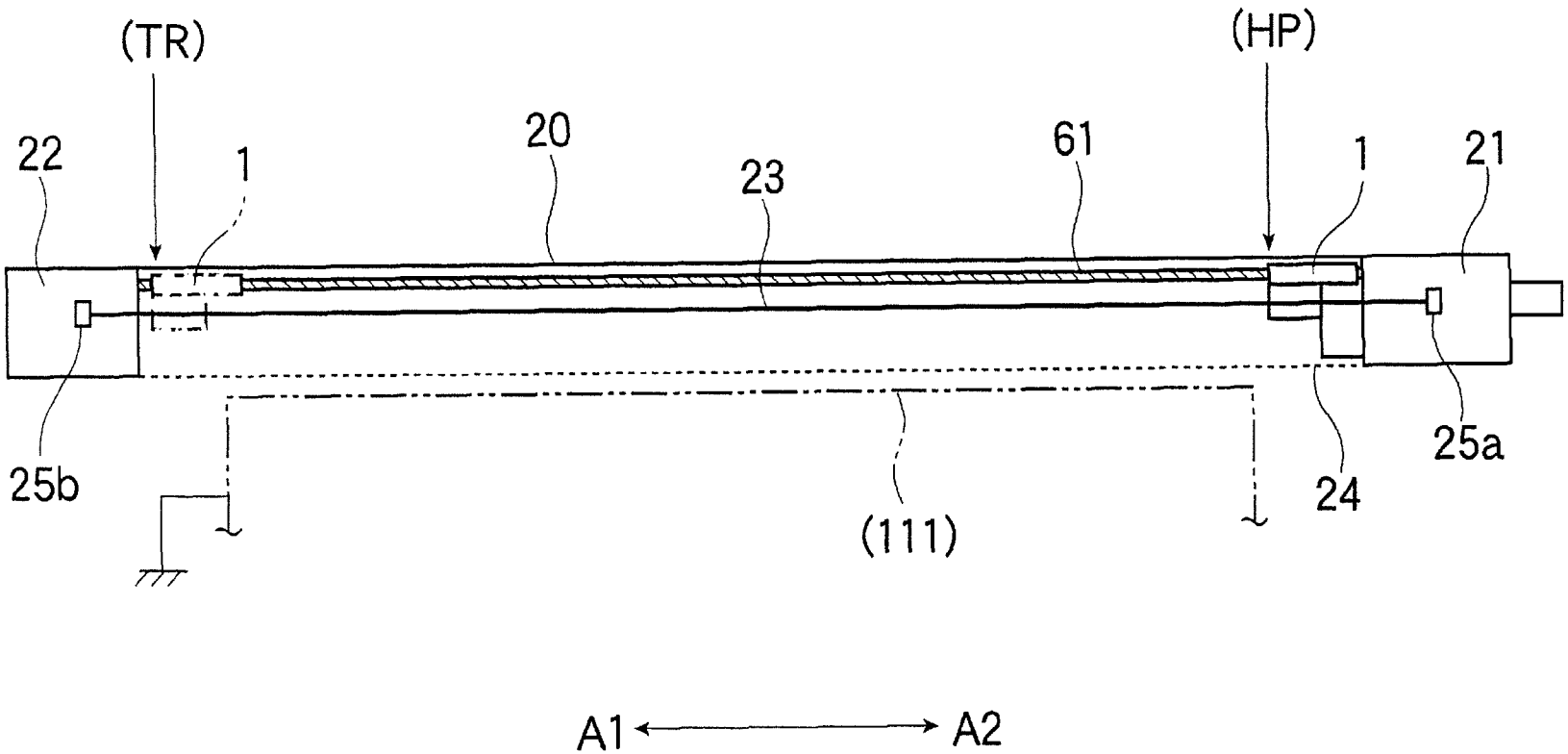
FIG. 4 is a schematic illustration schematically showing a primary portion of a charging device in which the cleaning device shown in FIG. 1 is used.

As shown in FIGS. 1, 3 and 4, the charging device 2 includes: a shield case (a cover member) 20 having a rectangular ceiling plate and side plates hanging downward from both end portions in the longitudinal direction of the ceiling plate; end portion supporting bodies 21, 22 attached to both end portions of the shield case 20; a discharge wire 23 (corona discharge wire), which is an example of the wire, and which is attached being substantially linearly stretched passing through an inner space of the shield case between these two end portion supporting bodies 21, 22; and a grid-shaped electric field adjusting plate (a grid electrode) 24 which is attached to a lower opening portion of the shield case 20 and covers the opening portion so that it can exist between the discharge wire 23 and the circumferential face of the photoreceptor drum 111. That is, the charging device 2 is a so-called scorotron type charging device. Reference numerals 25*a* and 25*b* in FIG. 4 show an attaching portion to which an end portion of the discharge wire 23 is attached.

This charging device 2 is arranged so that the discharge wire 23 can be opposed to the circumferential face of the photoreceptor drum 111 while a predetermined interval (for example, a predetermined discharge gap) is being formed between the circumferential face of the photoreceptor drum 111 and the discharge wire 23 and so that the discharge wire 23 can exist at least in the image forming region along the axial direction of the rotary shaft of the photoreceptor drum 111. Voltage for charging is applied to the discharge wire 23 (between the discharge wire 23 and the photoreceptor drum 111) of the charging device 2 by an electric power source not shown.

The discharge wire 23 may be a wire capable of generating corona discharge and electrically charging the circumferential face of the photoreceptor drum 111 which is a body to be electrically charged. For example, a metallic wire made of tungsten, the outer diameter of the cross-section of which is 30 to 60 μmϕ, is used.

At the time of forming an image (at the time of an image forming action), voltage for electrically charging is applied to the discharge wire 23 by the charging device 2. Due to the foregoing, corona discharge is generated under the condition that an electric field is formed between the discharge wire 23 and the circumferential face of the photoreceptor drum 111. As a result, the circumferential face of the photoreceptor drum 111 is electrically charged. At this time, an electric potential of charging of the photoreceptor drum 111 is adjusted by the electric field adjusting member 24.

In some cases, the charging device 2 can not sufficiently and uniformly generate corona discharge and a failure of charging such as unevenness of charging is generated because the discharge wire 23 is attached with and polluted by objects which have been generated at the time of discharging and because the discharge wire 23 is also polluted by the substance such as an additive agent of toner. Therefore, the charging device 2 is provided with a cleaning device 1 for cleaning the discharge wire so as to remove the adhering objects adhering to the discharge wire 3.

The cleaning device 1 of the discharge wire will be explained as follows.

Figure 5:
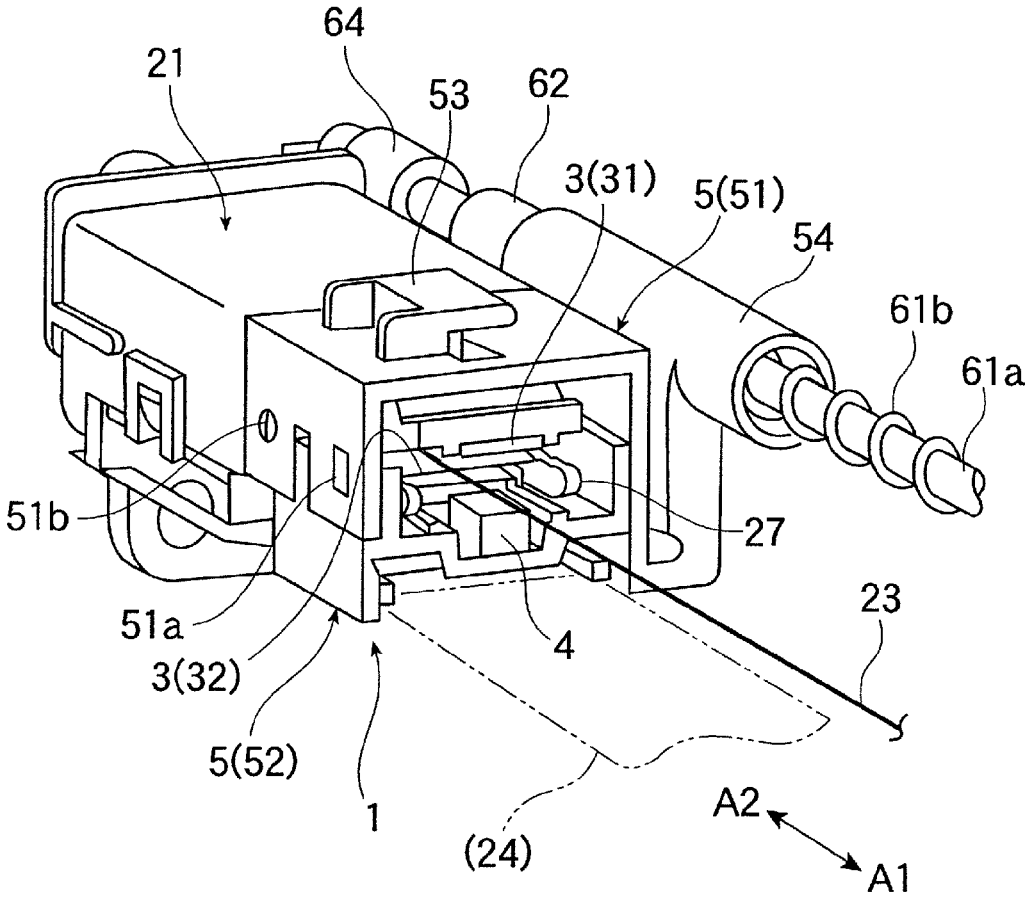
FIG. 5 is a perspective view mainly showing the cleaning device shown in FIG. 1.
Figure 6:
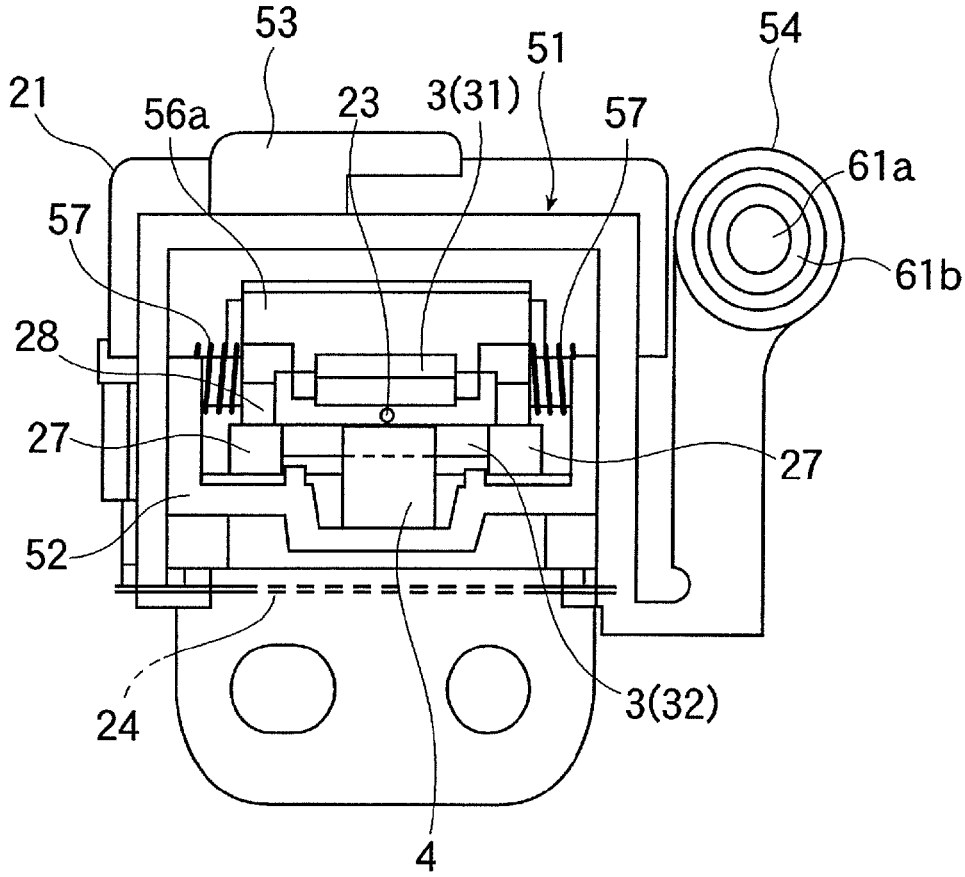
FIG. 6 is a side view showing a state in which the cleaning device shown in FIG. 5 is viewed in the direction of the arrow A2.
Figure 7:
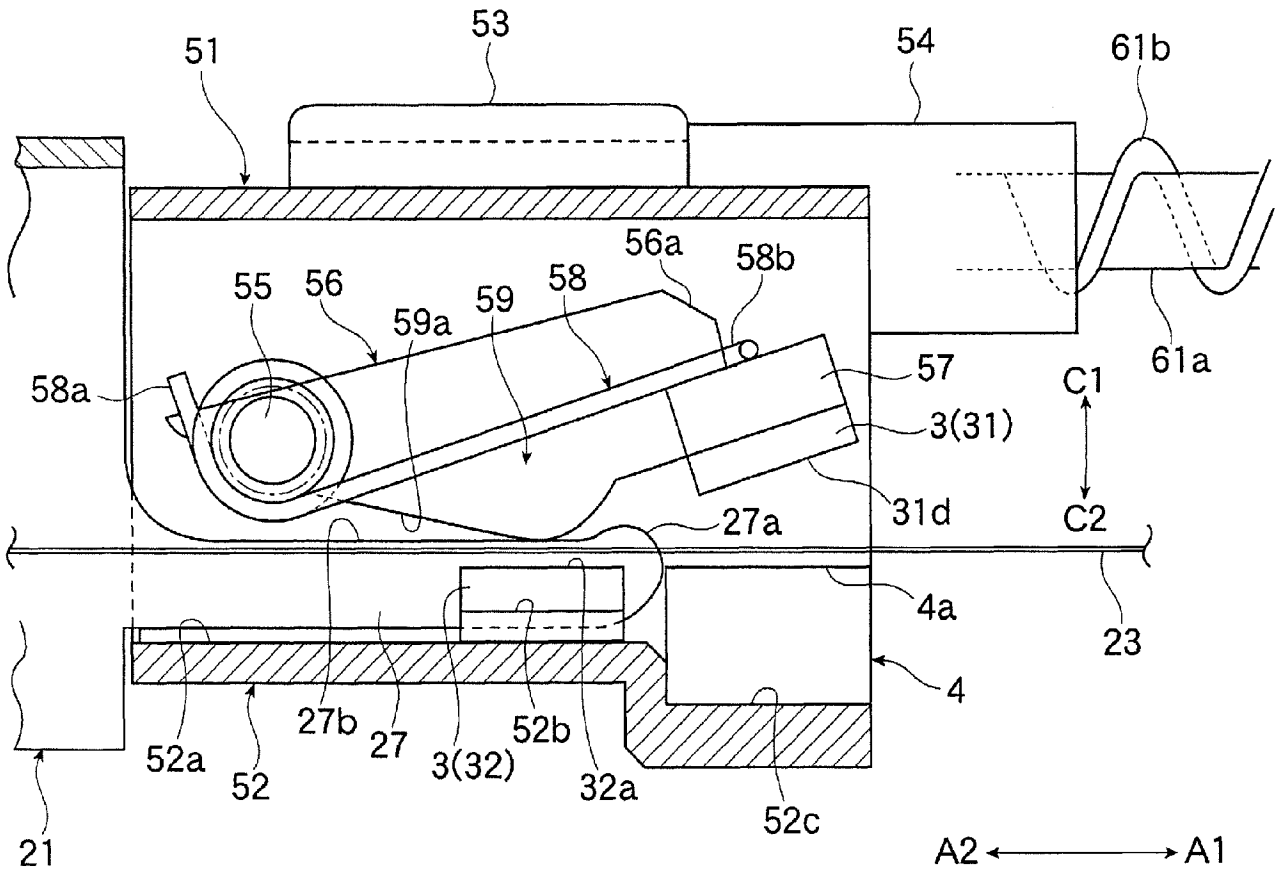
FIG. 7 is a schematic illustration showing a state in which a cleaning device is located at a waiting and stopping position.

As shown in FIGS. 5 to 7, the cleaning device 1 includes: a first cleaning pad 3 coming into contact with the discharge wire 23; a second cleaning pad 4 coming into contact with the first cleaning pad 3 (one cleaning pad) in such a manner that the discharge wire 23 is interposed between the first and the second cleaning pad; and a holding and moving body 5 for holding the first cleaning pad 3 and the second cleaning pad 4 and for reciprocating them in the direction in which the discharge wire 23 is stretched (the direction indicated by the arrowed mark A).

At the time of non-cleaning in which cleaning is not executed, the cleaning device 1 moves to and stops at the waiting and stopping position (the home position) HP close to one end portion supporting body 21 (for example, the end portion supporting body arranged on the rear side of the charging device) of the charging device 2. On the other hand, at the time of cleaning in which cleaning is executed, the cleaning device 1 moves from the waiting and stopping position (the home position) HP to the turning position TP close to the other end supporting body 22 of the charging device 2. After that, the cleaning device 1 returns to the waiting and stopping position HP. In this way, the cleaning device 1 reciprocates. In this case, the movement of the cleaning device 1 shown by the arrowed mark A1 directed from the waiting and stopping position HP to the turning position TP is defined as "a going-forth movement". On the contrary, the movement of the cleaning device 1 shown by the arrowed mark A2 directed from the turning point TP to the waiting and stopping position HP is defined as "a going-back movement".

The holding and moving body 5 for realizing the movement described above includes: an upper frame body 51 arranged in an inner space of the shield case 20 of the charging device 2 so that the upper frame body 51 can be located on an upper side of the discharge wire 23; and a lower frame body 52 arranged in the inner space of the shield case 20 so that the lower frame body 52 can be located on a lower side of the discharge wire 23 and be attached to and integrated with a lower portion of the upper frame body 51. In this case, in this exemplary embodiment, the upper side of the discharge wire 23 is an opposite side to the side on which the photoreceptor drum 111 is arranged and the lower side of the discharge wire 23 is the same side as the side on which the photoreceptor drum 111 is arranged.

The upper frame portion 51 is composed as follows. The upper frame portion 51 has a body portion including a ceiling plate having a rectangular shape and side plates. The side plates hangs downward from a pair of both end portions of the ceiling. The upper frame portion 51 has a guide receiving portion 53 which is formed on the ceiling plate and protrudes outside. The guide receiving portion 53 has a cross-section which is bent into an L-shape. When this guide receiving portion 53 is hooked at the edge portion 26*a* (shown in FIG. 1) of the rectangular guide hole 26 formed on the shield case 20 along the direction in which the discharge wire 23 is stretched, the upper frame body 51 can be freely moved in the longitudinal direction of the guide hole 26.

In addition, the upper frame portion 51 has a tube-shaped passive supporting portion 54 is formed on one side of the upper frame portion 51. The tube-shaped passive supporting portion 54 is attached through a screw to a screw type driving shaft 61 arranged substantially in parallel with the direction A, in which the discharge wire 23 is stretched. And the tube-shaped passive supporting portion 54 is outside (the side portion) of the shield case 20 of the charging device 2. The upper frame body 51 is supported being capable of reciprocating in the direction indicated by the arrows A1, A2 when the passive supporting portion 54 receives a driving force along the drive shaft 61 generated by a normal and reverse rotation of the screw type driving shaft 61.

The screw type driving shaft 61 has a protruding portion 61*b* which is formed being spirally wound round a rod-shaped shaft 61*a*. The screw type driving shaft 61 is pivotally attached to the bearings 62, 63 respectively arranged in the end portion supporting bodies 21, 22 of the charging device 2. The screw type driving shaft 61 is connected to a driving shaft for connection of the rotation driving and transmitting device 65 (shown in FIG. 1) through the shaft connecting member 64 attached to one end portion of the screw type driving shaft 61.

Figure 8:
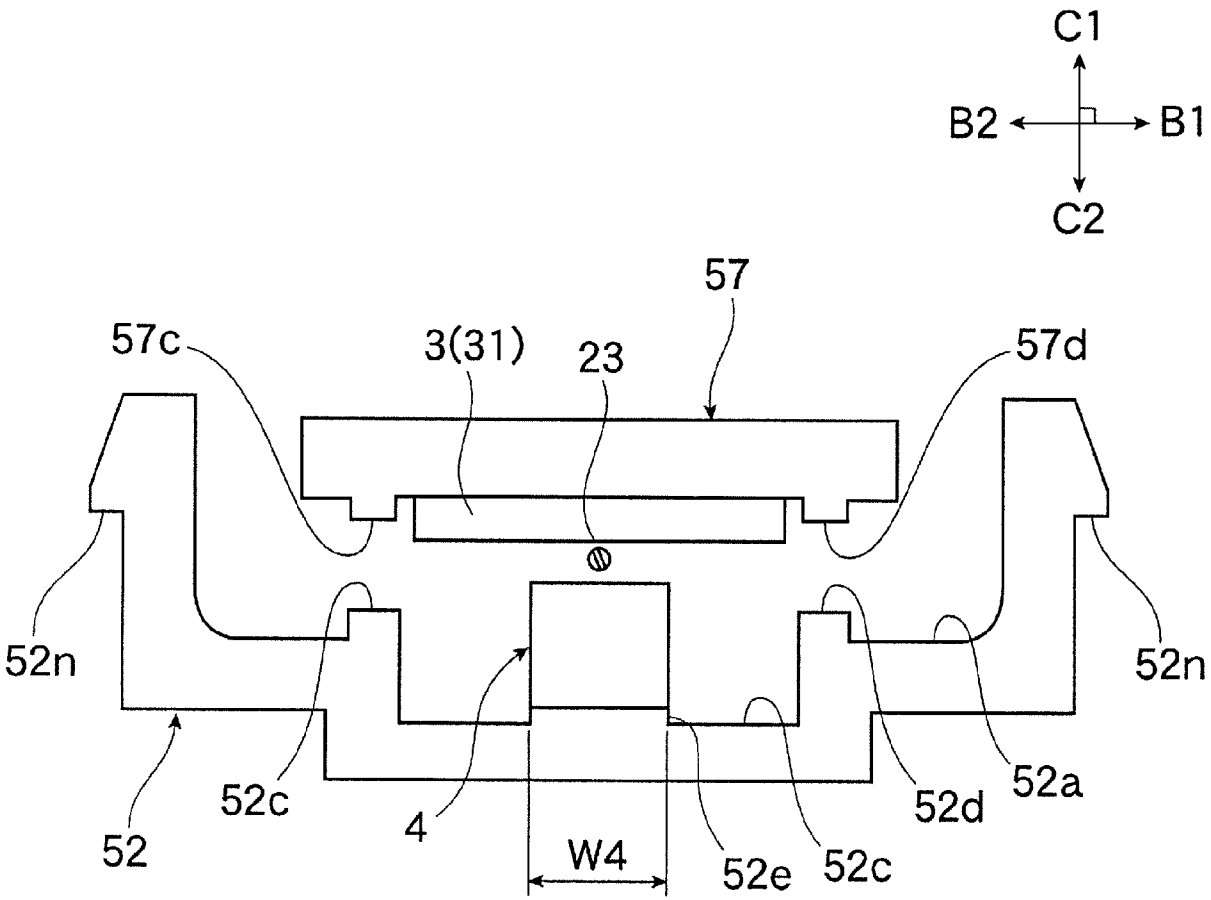
FIG. 8 is a side view showing a state in which a primary portion of the cleaning device shown in FIG. 7 is viewed in the direction of the arrow A2.

The lower frame body 52 has a rectangular base plate and side plate portions rising upward from a set of both end portions of the base plate. This lower frame body 52 is integrated with the upper frame body 51 in the following manner. For example, as shown in FIG. 8, the protrusions 52*n* are formed on the outer faces of both side plates interposing the discharge wire 23. The protrusions 52*n* are inserted from the inside of the upper frame body 51 into hooking holes 51*a* (shown in FIG. 5) formed on the side walls of the upper frame body 51 so that the protrusions 52 are hooked at the hooking holes 51*a*. In this way, the lower frame body 52 is integrated with the upper frame body 51.

The first cleaning pad 3 has two cleaning pads 31 and 32.

As shown in FIGS. 7 and 8, the first cleaning pad 3 is arranged as follows. One cleaning pad 31 of the first cleaning pad 3 is arranged on the opposite side to the photoreceptor drum 111 side so that one cleaning pad 31 can be contacted with the discharge wire 23. The other cleaning pad 32 of the first cleaning pad 3 is arranged on the photoreceptor drum 111 side so that one cleaning pad 32 can be contacted with the discharge wire 23. The other cleaning pad 32 is arranged on the side distant from the end portion supporting body 21 of one cleaning pad 31 while the interval S is being maintained from one cleaning pad 31. That is, the first cleaning pad 3 is arranged in such a manner that one cleaning pad 31 and the other cleaning pad 32 are arranged on both sides of the discharge wire 23 while the interval S is being maintained between one cleaning pad 31 and the other cleaning pad 32 in the direction A in which the discharge wire 23 is stretched.

The first cleaning pad 3 is attached so that one cleaning pad 31 can be displaced in a direction in which one cleaning pad 31 comes close to and separates from the discharge wire 23 in the upper frame body 51 of the holding and moving body 5. The constitution described above is made for the following reasons. When the cleaning device 1 stops at the waiting and stopping position TP at the time of non-cleaning, the cleaning pad 31 can be maintained in a state in which the cleaning pad 31 is separate from the discharge wire 23 and the second cleaning pad 4. On the other hand, only at the time of cleaning, the cleaning pad 31 can be maintained in a state in which the cleaning pad 31 comes into contact with the second cleaning pad 4 while the discharge wire 23 is being interposed between the cleaning pad 31 and the second cleaning pad 4. Specifically, as shown in FIGS. 5 to 8, an oscillating member 56 is provided which oscillates round a shaft 55 in the direction C1 in which the free end portion comes close to the discharge wire 23 and also in the direction C2 in which the free end portion separates from the discharge wire 23. To a holding plate portion 57 formed on a lower portion of a free end portion 56*a* of the oscillating member 56, one cleaning pad 31 is attached. The shaft 55 is inserted into and supported by the bearing holes 51*b* (shown in FIG. 5) formed on the sides of the upper frame body 51.

Further, the other cleaning part 32 of the first cleaning pad 3 is attached being fixed to the lower frame body 52 of the holding and moving body 5. Specifically, as shown in FIGS. 5 to 7, in the lower frame body 52, the holding table 52*b* is formed which rises from the substantially central portion of the upper face portion 52*a* of the base plate opposed to the discharge wire 23.

The second cleaning pad 4 is attached being fixed to the lower frame body 52 of the holding and moving body 5. Specifically, as shown in FIGS. 5 to 8, the recess portion 52*c* is formed so that the recess portion 52*c* can be lowered by one stage from the upper face portion 52*a* in a portion of the base plate of the lower frame body 52. The second cleaning pad 4 can be contacted with one cleaning pad 31 in such portion while the discharge wire 23 is being interposed between the second cleaning pad 4 and one cleaning pad 31. The second cleaning pad 4 is attached to this recess portion 52*c*. The reason why this recess portion 52*c* is formed is that when the second cleaning pad 4 comes into contact with the first pad 31, the pads can be easily elastically deformed and compressed, and a height of the upper face of the second cleaning pad 4 is made to be the same as that of the upper face of the first pad 32.

In this case, in order for the cleaning pad 31 to come into contact with the second cleaning pad 4 while the discharge wire 23 is being interposed between the cleaning pad 31 and the second cleaning pad 4 at the time of cleaning, the oscillating member 56 is maintained in a state in which the oscillating member 56 is elastically pushed by the coil spring 58 in the direction C2 in which the oscillating member 56 comes close to the discharge wire 23. The coil spring 58 is attached in such a manner that the coil portion of the coil spring 58 is attached to the shaft 55 and one end portion 58*a* is fixed to the upper frame body 51 and the other end portion 58*b* is arranged so that it can push the back side of the holding plate portion 56*a*.

In order for the cleaning pad 31 to be maintained at a position separate from the discharge wire 23 and the second cleaning pad 4 at the time of non-cleaning, the oscillating member 56 is oscillated in the direction C1 in which the oscillating member 56 is separated from the discharge wire 23 resisting a pushing force of the coil spring 57 in the process in which the cleaning device 1 is moved toward the waiting and stopping position TP in the direction of the arrows A2.

In order to realize the oscillation of the oscillating member 56 at this time, for example, a protruding portion 59 is formed in a lower face portion directed from the end portion supported by the shaft 55 of the oscillating member 56 to the free end portion. The protruding portion 59 has an inclined face portion 59*a* gradually protruding in the direction C2 in which it comes close to the circumferential face of the photoreceptor drum 111. And a guide piece 27 is formed in the end portion supporting body 21 of the charging device 2. The guide piece 27 protrudes substantially along the direction A in which the discharge wire 23 is stretched is formed. Due to the above structure, when the cleaning device 1 is moved toward the waiting and stopping position TP in the direction of the arrow A2, the inclined face portion 59*a* of the protruding portion 59 moves coming into contact with a forward end portion 27*a* which is formed in a curved shape, of the guide protruding piece 27. Due to the foregoing, the free end portion side of the oscillating member 56 is oscillated being lifted upward (in the direction C1 in which the oscillating member 56 is separated from the photoreceptor drum 111). When the protruding portion 59 (the top portion) finally runs on a horizontal guide face portion 27*b* and is held, the free end portion side of the oscillating member 56 is maintained being lifted upward.

As shown in FIGS. 7 and 8, when the cleaning device 1 is stopped at the waiting and stopping position TP at the time of non-cleaning, the discharge wire 23 is maintained in a state in which the discharge wire 23 is not contacted with either the first cleaning pad 3 (31, 32) or the second cleaning pad 4. Due to the foregoing, the discharge wire 23 can be maintained in a state in which a predetermined interval is formed between the discharge wire 23 and the circumferential face of the photoreceptor drum 111 at the time of the charging operation. In FIG. 8, reference numerals 52*c* and 52*d* are protruding portions formed in the base plate face portion 52*a* of the lower frame body 52 on both sides of the second cleaning pad 4. Reference numerals 57*c* and 57*d* are protrusions for regulating an amount of contact which are provided on both sides of the first cleaning pad 31 in the holding plate portion 57 of the oscillating member 56. Height of the protrusion for regulating an amount of contact is determined to be a protruding height for regulating an amount of contact of the first cleaning pad 31 with the second cleaning pad 4 when the oscillating member 57 comes into contact with the protrusions 52*c*, 52*d* of the lower frame body 52 at the time of cleaning.

Figure 9:
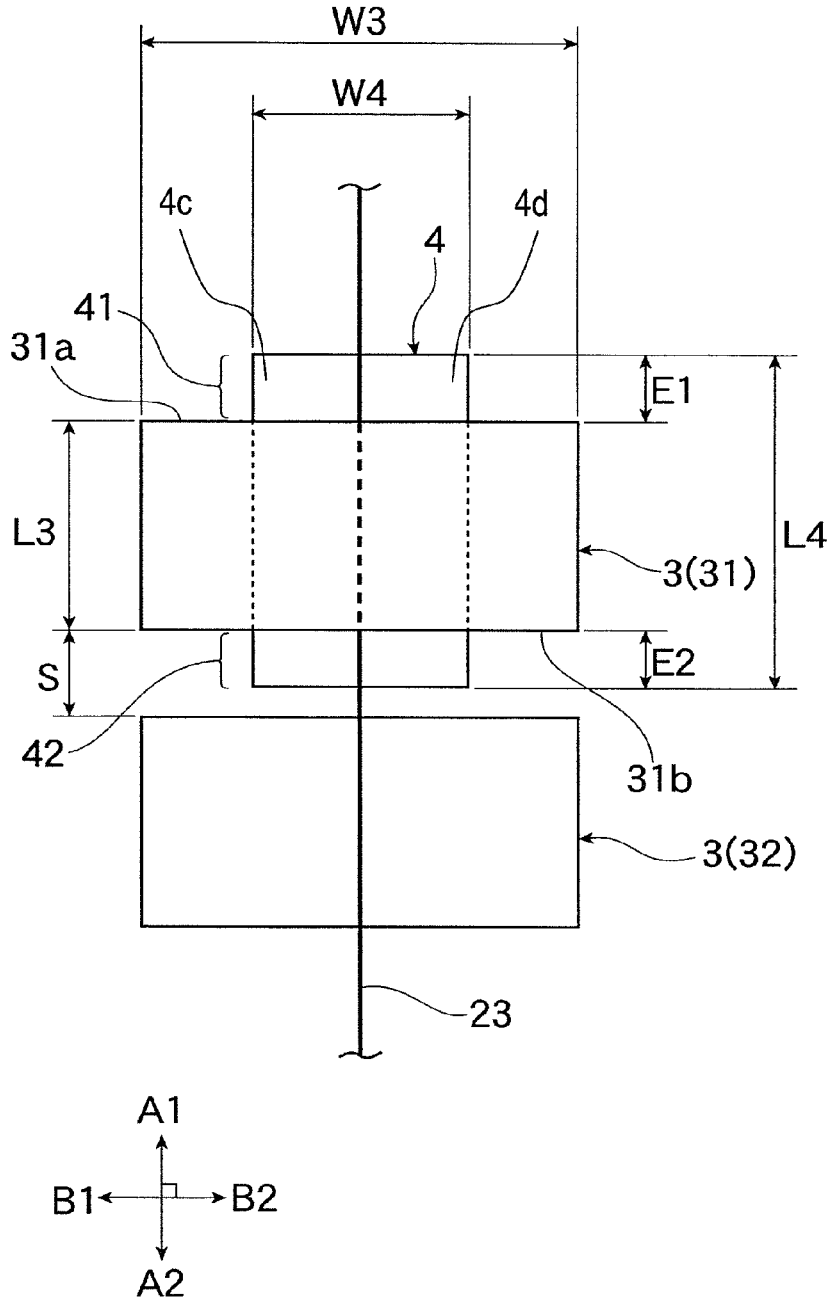
FIG. 9 is a schematic illustration showing the constitution of the first and the second cleaning pad.

The first cleaning pad 3 (31, 32) is made of material containing abrasive material. As shown in FIG. 9, the first cleaning pad 3 uses a member, the face coming into contact with the discharge wire 23 of which is rectangular. Specifically, the cleaning pads 31, 32 are made of material in which a predetermined quantity of abrasive material of white alumina is mixed with material such as epoxy resin. By using a member made of material containing the abrasive material, a rectangular parallelepiped is formed, the length L3 in the discharge wire stretching direction A of which is 3 to 6 mm, the width W3 in the direction B perpendicular (in the crossing state in which the crossing angle is, for example, in the range from 85° to 95°) to the discharge wire stretching direction A of which is 5 to 8 mm, and the thickness of which 0.5 to 2 mm. These cleaning pads 31 and 32 are fixed to the holding plate portion 57 and the holding table portion 52*b*, for example, by additive.

The second cleaning pad 4 was formed out of a member made of porous elastic material, the percentage of voids of which was not less than 90%. As shown in FIG. 9, a face of the member coming into contact with the discharge wire 23 was rectangular. Specifically, polyurethane foam material was used and applied to the wind blowing method. That is, the material (the percentage of voids: 97%) was used. By using the material, a shape of a rectangular parallelepiped was formed, the length L4 in the discharge wire 23 stretching direction A of which was 6 to 7.2 mm, the width W4 in the direction perpendicular to the stretching direction A of which was 3 to 6 mm, and the thickness of which was 2 to 4 mm. The porous elastic member composing the cleaning pad 4 is relatively softer than the member containing abrasive material composing the first cleaning pad 3 (31). This cleaning pad 4 is fixed to the recess portion 52*c*, for example, by adhesive. The hardness of this porous elastic material is 70 to 130 N. In this case, the hardness was measured by the measurement method described later.

Figure 10:
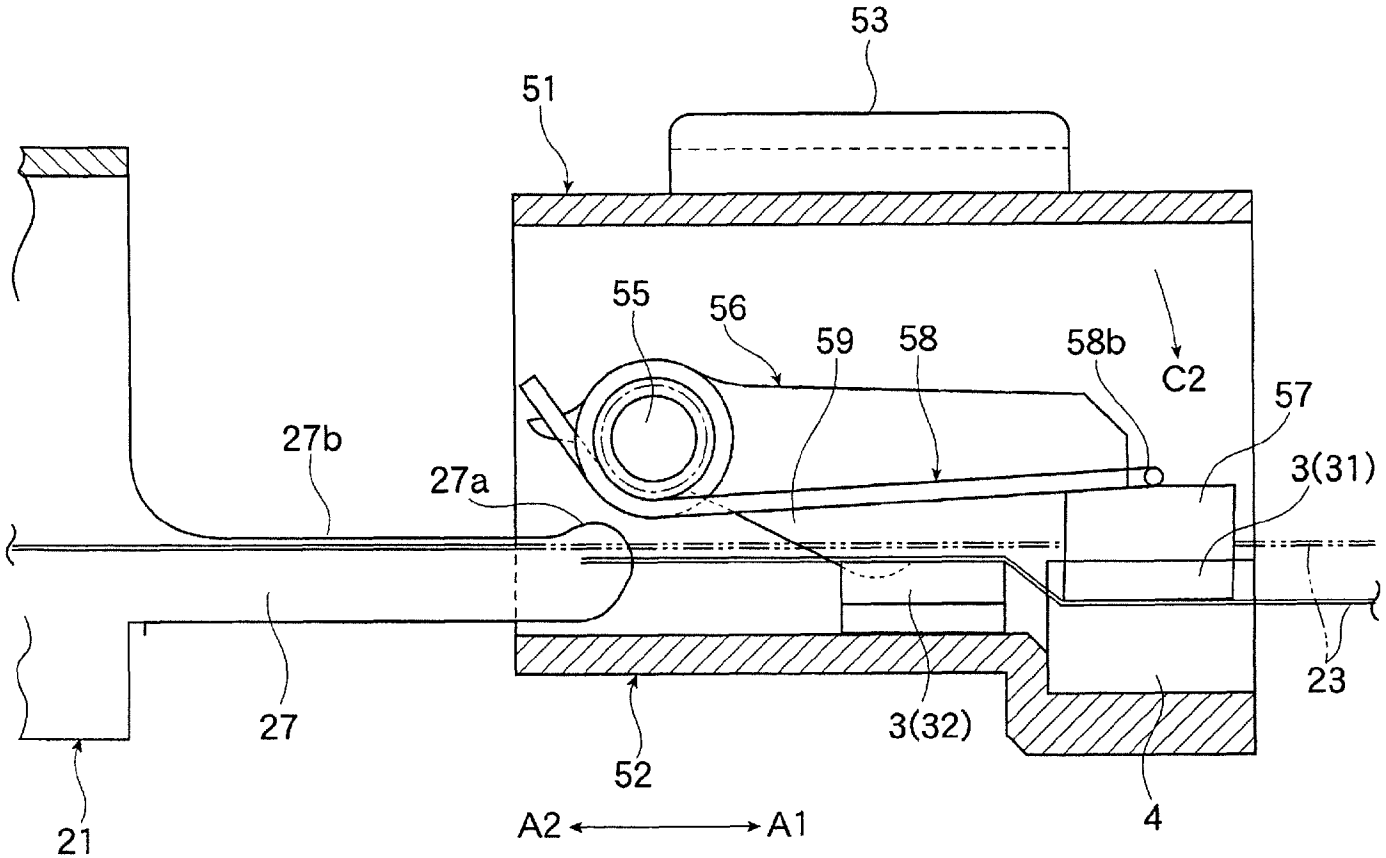
FIG. 10 is a schematic illustration showing a state in which a cleaning device is moved out from a waiting and stopping position (at the time of cleaning)

In this cleaning device 1, when the first cleaning pad 31 comes into contact with the second cleaning pad 4 while the discharge wire 23 is being interposed between the first cleaning pad 31 and the second cleaning pad 4 at the time of cleaning, as shown in FIGS. 9 and 10, the second cleaning pad 4 comes into contact with the discharge wire 23 while the second cleaning pad 4 is protruding from both end portions 31*a*, 31*b* at the time of a reciprocating movement of the first cleaning pad 31. In this case, the end portion 31*a* of the first cleaning pad 3 is a forward end portion at the time of the going-back movement and the end portion 31*b* of the first cleaning pad 3 is a rear end portion at the time of the going-back movement. In FIG. 9, reference numerals 41 and 42 are portions of the second cleaning pad 4 which protrude from both end portions 31*a*, 31*b* of the first cleaning pad 31 at the time of the going-back and forth movement. Reference marks E1 and E2 indicate an amount of protrusion (length) of the protruding portion.

Figure 11:
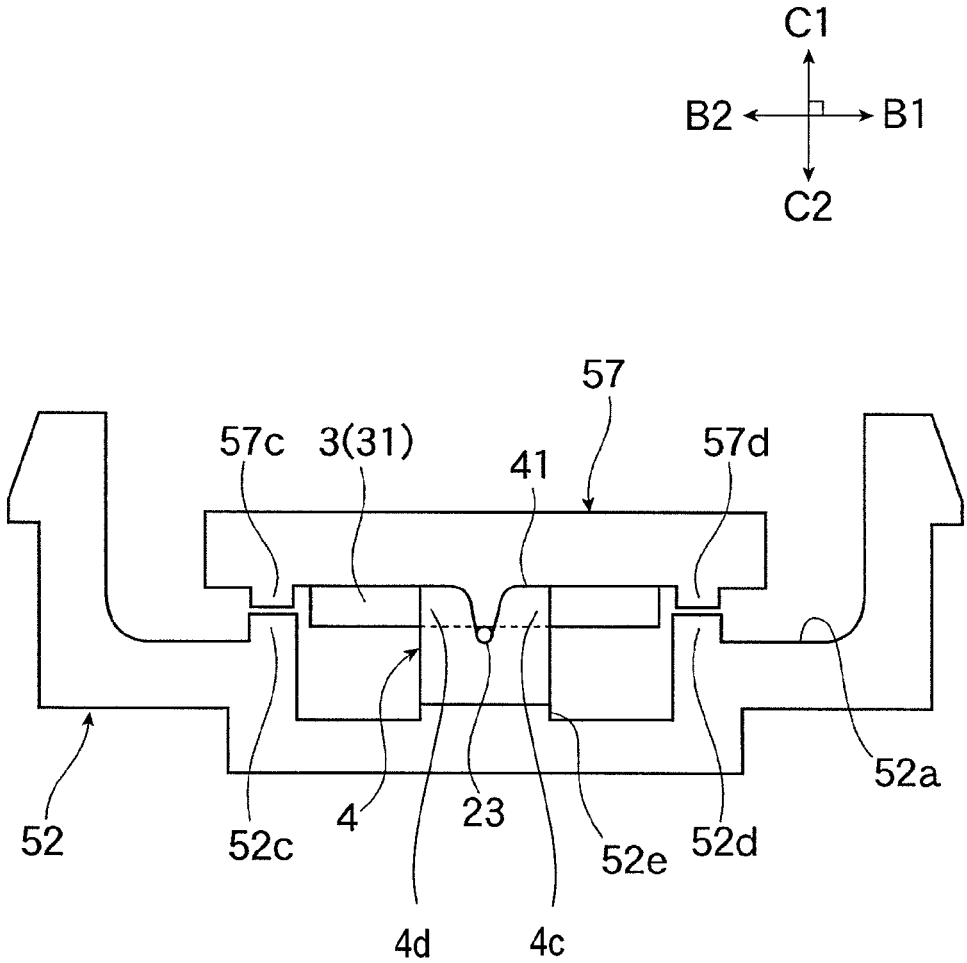
FIG. 11 is a side view showing a state in which a primary portion of the cleaning device shown in FIG. 10 is viewed from the direction of the arrow A2.

In this cleaning device 1, the width W3 of the first cleaning pad 31, which comes into contact with the second cleaning pad 4, is wider than the width W4 of the second cleaning pad 4 as shown in FIG. 9. Further, when the first cleaning pad 31 comes into contact with the second cleaning pad 4 while the discharge wire 23 is being interposed between the first cleaning pad 31 and the second cleaning pad 4, as shown in FIGS. 9 and 11, in the direction B perpendicular to the discharge wire 23 stretching direction A, the first cleaning pad 31 protrudes from both end portions 4*c*, 4*d* in the perpendicular direction B of the second cleaning pad 4.

Next, actions of this cleaning device 1 will be explained below.

As shown in FIGS. 4 and 5, at the time of non-cleaning, the cleaning device 1 stops at the waiting and stopping position HP close to one end portion supporting body 21 of the charging device 2.

At this time, since the oscillating member 56 for supporting one cleaning pad 31 is contacting with the guide protrusion piece 27 of the end portion supporting body 21 and is being oscillated in the direction C1 in which one cleaning pad 31 is separated from the circumferential face of the photoreceptor drum 111, one cleaning pad 31 is separate from both the discharge wire 23 and the second cleaning pad 4 as shown in FIGS. 6 to 8. In other word, one cleaning pad 31 is kept in a non-contact state.

Therefore, the discharge wire 23 of the charging device 2 is not contacted with any of three cleaning pads 31, 32, 4 of the cleaning device 1 as shown in FIGS. 7 and 8. Accordingly, the discharge wire 23 of the charging device 2 is set in a natural state in which the discharge wire 23 is stretched between two end portion supporting bodies 21, 22 of the charging device 2. Therefore, the discharge wire 23 of the charging device 2 is set in a state in which a predetermined interval is maintained between the discharge wire 23 and the circumferential face of the photoreceptor drum 111.

At the time of cleaning, the cleaning device 1 is reciprocated between the waiting and stopping position HP and the turning position TP as shown in FIG. 4. Examples of the cleaning time are: the time before and after the charging action of the charging device 2; the time at which a predetermined number of sheets have been subjected to the image forming actions; and the time at which working for improving the image quality is executed.

First, when the rotation drive transmitting device 65 of the screw type rotary shaft 61 is rotated in a predetermined direction, the cleaning device 1 starts moving toward the turning point TP through the passive supporting portion 54 which receives a drive force from the rotary shaft 61. That is, the cleaning device 1 starts a going-forth movement.

Figure 12:
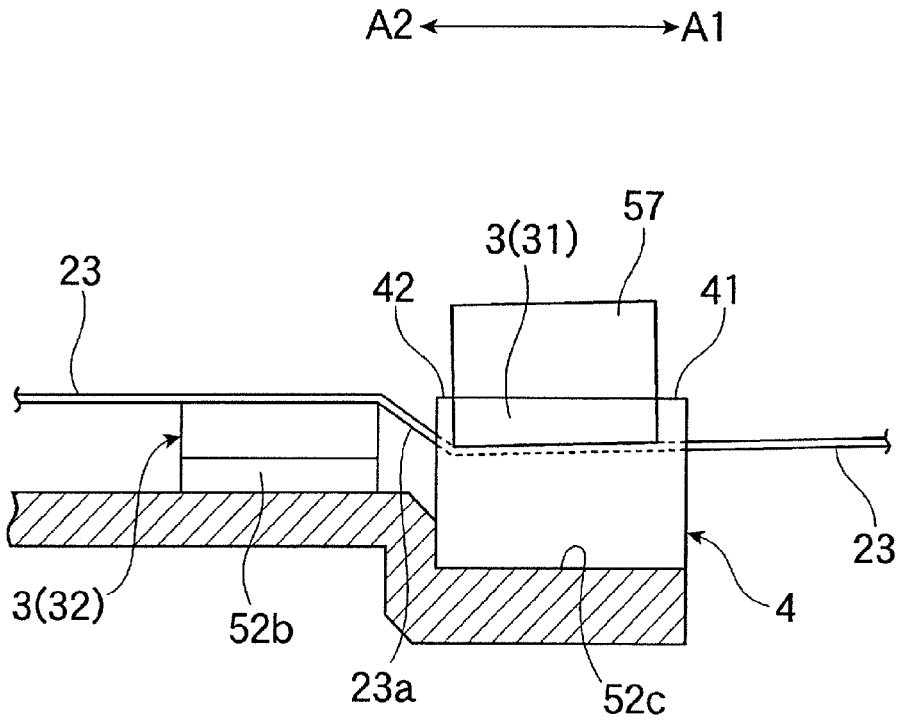
FIG. 12 is a schematic illustration showing a state in which the first cleaning pad, the second cleaning pad and the discharge wire in the cleaning device of FIG. 10 are shown.

Since the oscillating member 56 for holding one cleaning pad 31 of the first cleaning pad 3, is released from the contact with the guide protrusion piece 27 of the end portion supporting body 21 and is oscillated in the direction C2 in which the oscillating member 56 comes close to the circumferential face of the photoreceptor drum 111 as described before, one cleaning pad 31 comes into contact with the second cleaning pad 4 while the discharge wire 23 is being interposed between one cleaning pad 31 of the first cleaning pad 3 and the second cleaning pad 4 as shown in FIGS. 10 to 12.

Operation is described in details as follows. First, one cleaning pad 31 of the first cleaning pad 3 comes into contact with the discharge wire 23 from above, and the discharge wire 23 is pushed downward so that it can come close to the upper face 4*a* (shown in FIG. 7) of the second cleaning pad 4. At this time, the cleaning pad 31 pushes the discharge wire 23 downward until the discharge wire 23 is contacted with the upper face 32*a* (shown in FIG. 7) of the other cleaning pad 32.

Successively, the cleaning pad 31 is pushed by the oscillating member 56 which is oscillated in the direction of the arrow C2 being pushed by the coil spring 58. Therefore, while the discharge wire 23 is being interposed, the cleaning pad 31 further pushes the second cleaning pad 4 and is displaced downward being pressurized. At this time, the downward displacement of the cleaning pad 31 is continued until the protrusions 57*c*, 57*d* for regulating an amount of contact, which are provided in the holding plate portion 57 of the oscillating member 56, come into contact with the protruding portions 52*c*, 52*d* in the lower frame body 52.

As a result, as shown in FIGS. 10 and 12, when the lower face 31*d* (shown in FIG. 7) of one cleaning pad 31 comes down to a position lower than the upper face 32*a* of the other cleaning pad 32, both are pushed down. Accordingly, the discharge wire 23 is maintained in a bent state between the upper face 32*a* of the other cleaning pad 32 and the lower face 31*d* of one cleaning pad 31. At this time, one cleaning pad 31 is contacted with the discharge wire 23 from above and the other cleaning pad 32 is contacted with the discharge wire 23 from below. At the same time, the second cleaning pad 4 is contacted with one cleaning pad 31 and also contacted with the discharge wire 23 from below. Reference numeral 23*a* shown in FIG. 12 is a bent portion of the discharge wire.

Concerning the second cleaning pad 4, as shown in FIGS. 10 and 12, a portion of the second cleaning pad 4, which is pushed by one cleaning pad 31 of the first cleaning pad 3, is elastically deformed and compressed. On the other hand, portions 41 and 42 of the second cleaning pad 4, which are protruded from the front and the rear end portion 31*a*, 31*b* of one cleaning pad 31 in the discharge wire stretching direction A, are elastically deformed a little as shown in FIGS. 11 and 12. The portion 43 coming into contact with the discharge wire 23 is elastically deformed into a V-shaped bottom portion so that the discharge wire 23 can be pushed down and embedded by one cleaning pad 31 as shown in FIG. 11.

After the first cleaning pad 3 (31, 32) and the second cleaning pad 4 have been put into the state described above, the cleaning device 1 makes a going-forth movement to the turning point TP in the direction of the arrow A1 and then makes a going-back movement to the waiting and stopping position HP in the direction of the arrow A2.

Due to the foregoing, while the electric discharge wire 23 is being bent by the two cleaning pads 31, 32 of the first cleaning pad 3, the cleaning pads 31, 32 are moved being contacted with the discharge wire 23 from the upper and the lower side, so that a surface of the discharge wire 23 can be rubbed and cleaned. By this first cleaning pad 3, especially the adhering objects, which adhere to the discharge wire 23, the viscosity of which is relatively high, such as objects generated by the discharge are removed being scraped off by the cleaning pad 3.

When the second cleaning pad 4, which has been compressed by the cleaning pad 31, comes into contact with a lower side of the discharge wire 23 and moves, a surface of the discharge wire 23 is rubbed and cleaned. By this second cleaning pad 4, especially the adhering objects, the viscosity of which is relatively low, such as an additive agent added to the toner particles adhering to the discharge wire 23 are wiped off. At this time, the second cleaning pad 4 is not singly contacted with the discharge wire 23 but contacted being opposed to one cleaning pad 31 of the first pad 3. Therefore, cracks are seldom generated by the contact with the discharge wire 23.

Further, as shown in FIGS. 10 to 12, in this cleaning device 1, the protruding portions 41, 42 of the second cleaning pad 4 come into contact with the discharge wire 23. Due to this structure, even when the adhering objects generated by the discharge, which have been removed by the first cleaning pad 3 (31, 32), remain on the discharge wire 23, they can be caught and wiped off by the protruding portions 41, 42 of the second cleaning pad 4.

Especially, the protruding portion 41 of the second cleaning pad 4 is moved being contacted last with the discharge wire 23 at the time of a going-back movement of the cleaning device 1. Therefore, the protruding portion 41 of the second cleaning pad 4 catches the adhering objects remaining even after the removal of the adhering objects from the surface of the discharge wire 23. Since the second cleaning pad 4 is made of porous elastic material, the percentage of voids of which is high, a large number of voids are existing and the adhering objects, which have remained and been caught, are accommodated in the voids.

In this cleaning device 1, the second cleaning pad 4 is surely compressed being pushed by the cleaning pad 31 of the first cleaning pad 3, the width (W3) of which is wide, while the discharge wire 23 is being interposed between the second cleaning pad 4 and the cleaning pad 31 of the first cleaning pad 3. Accordingly, the contact pressure of the second cleaning pad 4 with the discharge wire 23 can be increased. Due to the foregoing, it is possible to obtain a high cleaning capacity of the discharge wire 23 by the second cleaning pad 4. Further, since the second cleaning pad 4 is held by the holding table 52*e* rising by the same width as the width (W4) of the pad from the recess portion 53*c* of the lower frame body 52 as shown in FIG. 11, the pressure given to the cleaning pad 31 is received by the entire pad. As a result, a force given from the discharge wire 23 is absorbed (received) by the cleaning pad 31. Accordingly, even when the second cleaning pad 4 is coming into contact with the discharge wire 23, cracks are seldom generated in the second cleaning pad 4.

When the cleaning device 1 is moved to and stopped at the waiting and stopping position HP by a going-forth movement, the cleaning actions of the cleaning device 1 are completed. In this cleaning device 1, even when the cleaning actions are repeated over a long period of time, although the cleaning pad 4 is made of material, the hardness of which is lower than that of the first cleaning pad 3, the cleaning pad 4 is seldom damaged by the contact (the sliding contact) with the discharge wire 23.

In the charging device 2 cleaned by this cleaning device 1, the discharge wire 23 can be cleaned in such a manner that the adhering objects of a different type, the viscosity of which is different, can be excellently removed from the discharge wire 23. Further, there is no possibility that the removed adhering objects are remaining. As a result, when charging is executed by the charging device 2 which has been cleaned as described above, a failure of charging such as unevenness of charging or incomplete charging, which is caused by the existence of the adhering objects adhering to or remaining on the discharge wire 23, is seldom caused.

Due to the foregoing, in the image forming apparatus 100 in which the charging device 2 having the above cleaning device 1 is used, a failure of an image such as stripes, which are caused by the defective charging, or fogging caused in the background portion seldom occurs.

Figure 13:
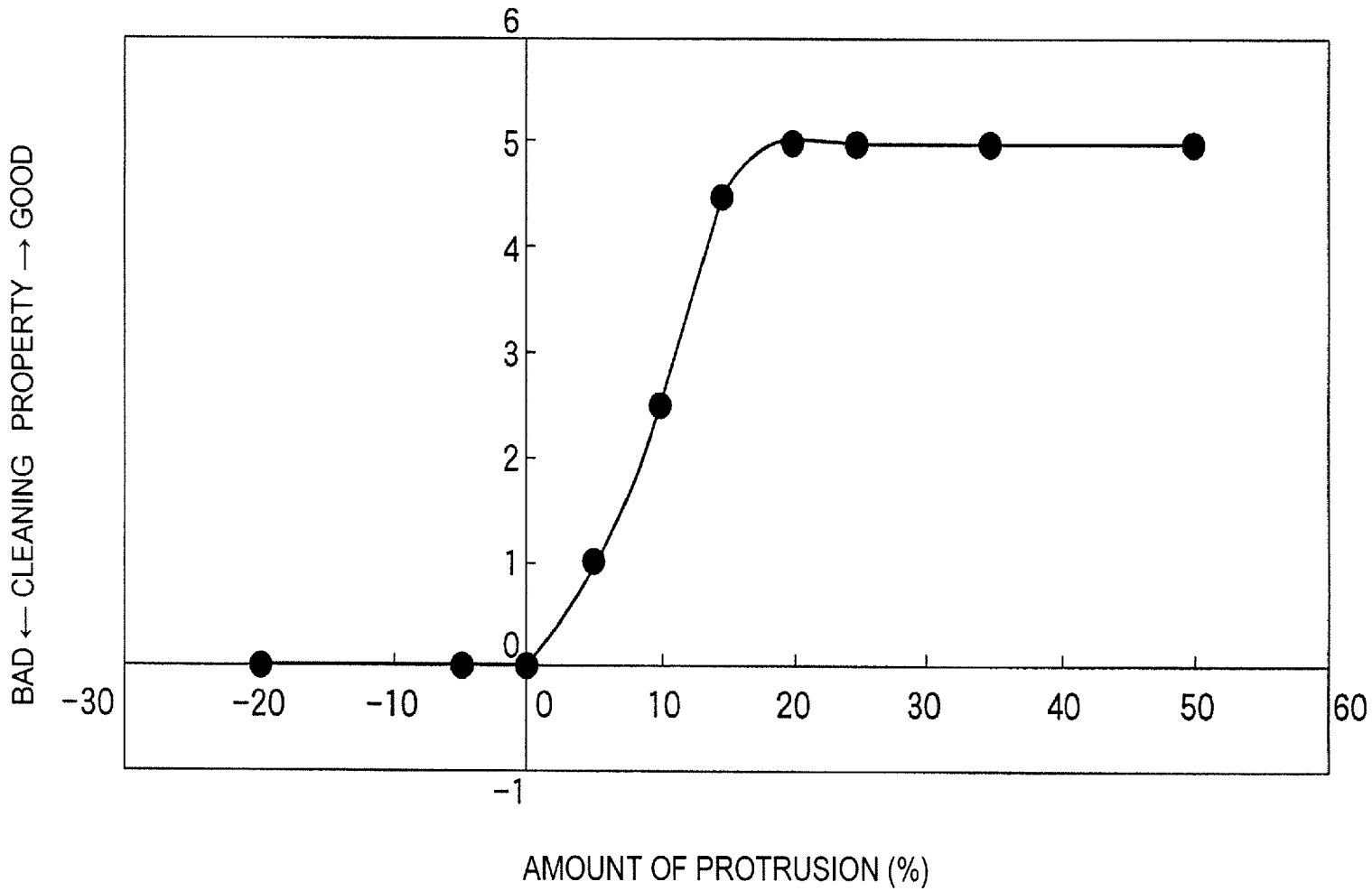
FIG. 13 is a graph showing an experimental result.

FIG. 13 is a graph showing a result of the experiment in which the cleaning result (the cleaning property) of the discharge wire 23 was investigated when an amount of protrusion of the protruding portion 41 (the protruding portion on the rear end side in the going-forth movement) of the first cleaning pad 4 was changed.

This experiment was made as follows. The dirty wire 23 was cleaned by the cleaning device 1 when it was mounted on the charging device 2 and corona discharge was generated under the same condition. After that, disturbance of the discharge distribution of the discharge wire 23 was measured. An amount (%) of protrusion shown on the axis of abscissa in FIG. 13 is a percentage of the protruding length E1 of the protruding portion 41 to the length L3 (showing FIG. 9) of the first cleaning pad 31. When this amount (%) of protrusion is a negative value, it shows a case in which the first cleaning pad 31 is arranged being protruded from the second cleaning pad 4. Concerning the cleaning property, a difference between the minimum voltage value and the maximum voltage value in the discharge distribution of the discharge wire 23 was measured and the obtained result was evaluated by the following reference.

1: 41 to 50 V
2: 31 to 40 V
3: 21 to 30 V
4: 11 to 20 V
5: 1 to 10 V
6: 0 V

According to the result shown in FIG. 13, concerning the protruding portion 41 of the first cleaning pad 4, it can be confirmed that an excellent result can be stably obtained when an amount of protrusion was set at a value not less than 20%.

Another Exemplary Embodiment

Figure 14:
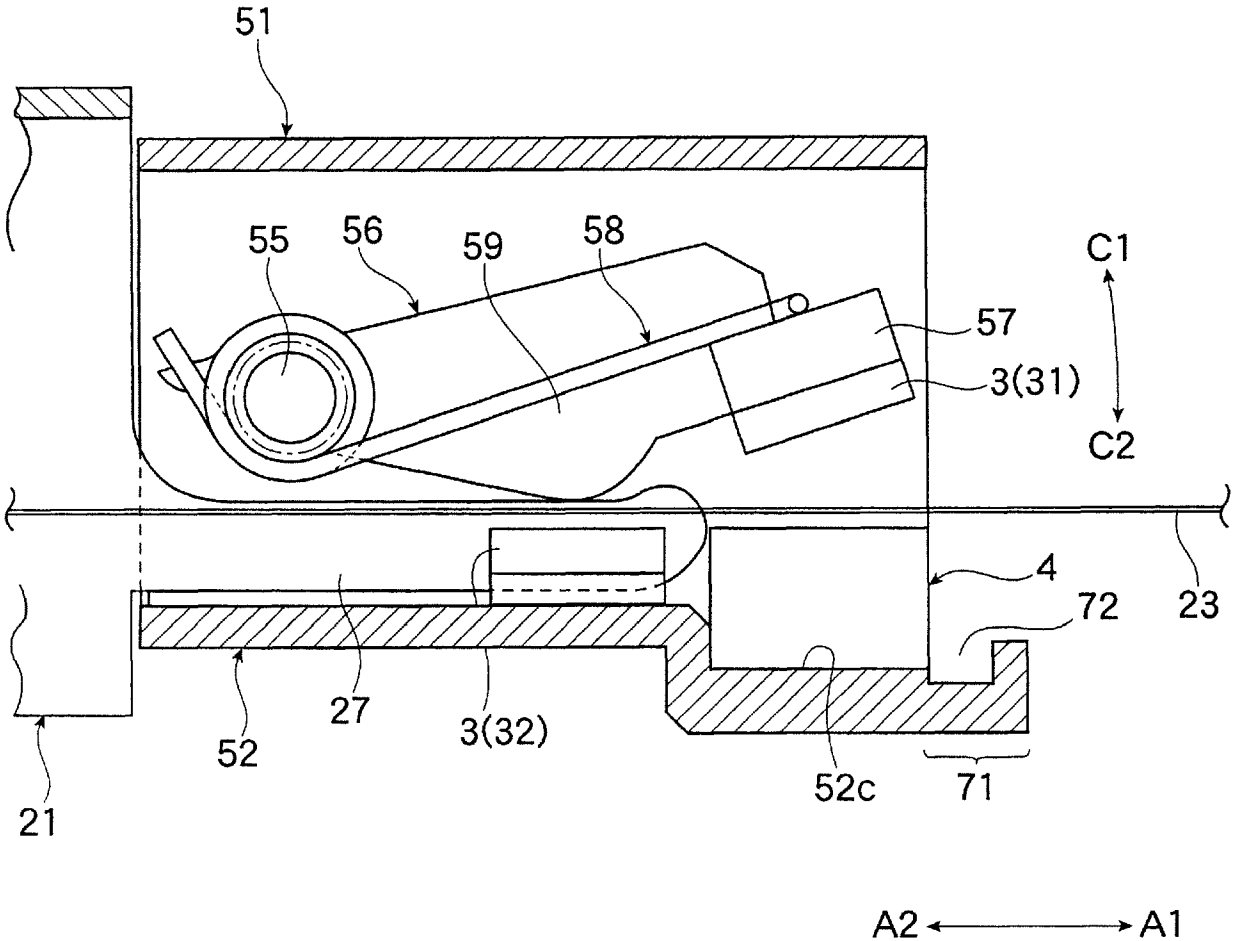
FIG. 14 is a schematic illustration showing a primary portion of another structural example, in which an accommodating portion is provided, of a cleaning device.
Figure 15:
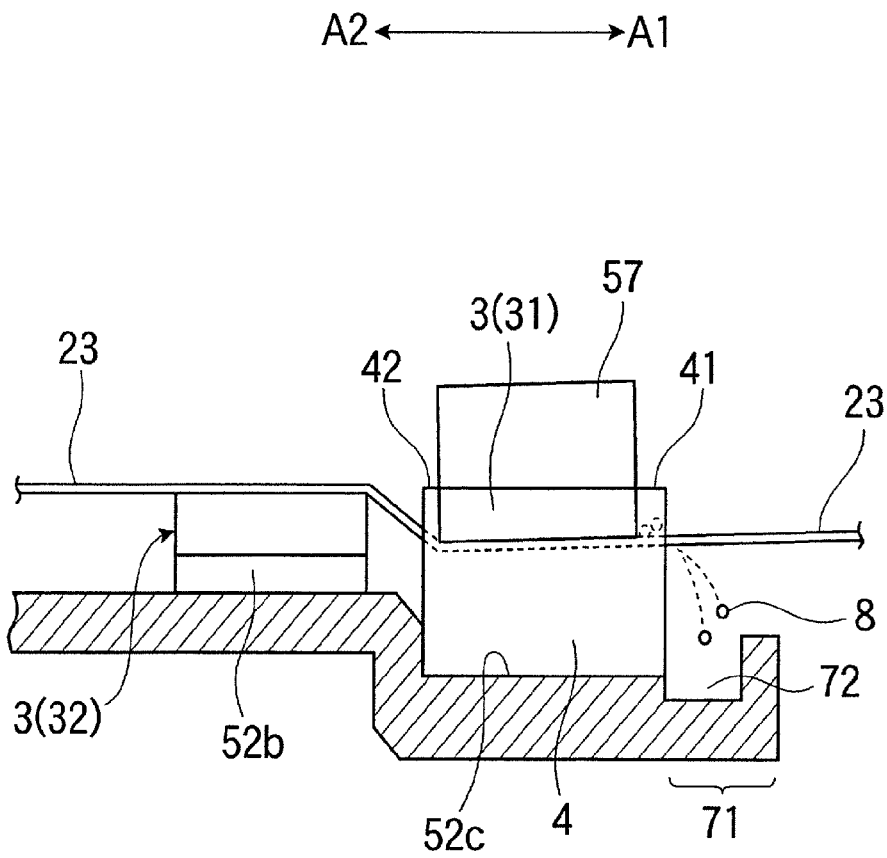
FIG. 15 is a schematic illustration in which the structural portion of FIG. 14 is shown being enlarged.

As shown in FIGS. 14 and 15, in the cleaning device 1 of the first exemplary embodiment, the accommodating portion 71 for accommodating a portion of the adhering objects removed from the discharge wire 23 can be provided in the recess portion 52*c* formed in the lower frame body 52 for holding the second cleaning pad 4. The accommodating portion 71 shown in FIG. 14 has an accommodating recess portion 72 surrounded by walls under the condition that the accommodating portion 71 is extended in the direction (the direction shown by the arrow A1) which is a backward direction of the recess portion 52*c* at the time of a going-back movement.

Due to the above structure, even a portion 8 of the adhering objects, which have been caught by the second cleaning pad 4 of the cleaning device 1, leak out (spill out) from the cleaning pad 4, the portion 8 of the adhering objects fall to the accommodating recess portion 72 and are accommodated in the accommodating portion. Due to the foregoing, the adhering objects can be prevented from falling off onto the circumferential face of the photoreceptor drum 111 which is an object to be electrically charged. For example, in the case where the second cleaning pad 4 is made of the porous elastic material described above, the percentage of voids of which is not less than 90%, there is a possibility that a portion 8 of the adhering objects, which have been caught by the voids, leak out from the voids which are continued to each other in many cases. Therefore, it is effective to provide such an accommodating portion 71.

Concerning the first cleaning pad 3 and the second cleaning pad 4 in the cleaning device 1, it is possible to use members made of other materials. For example, the first cleaning pad 3 can be a member made of synthetic resin attached with abrasive material such as alumina or glass fiber. The second cleaning pad 4 can be a member made of fiber material such as felt or non-woven fabric. Especially, the second cleaning pad 4 can be a member made of material, the hardness of which is lower than that of the member of the first cleaning pad 3. In this case, the hardness of both the first cleaning pad 3 and the second cleaning pad 4 was measured by the measuring method based upon JIS-K-6400. The hardness of the member of the second cleaning pad 4 is lower than that of the member of the first cleaning pad 3 by 60N or more.

In the cleaning device 1 of the first exemplary embodiment, the second cleaning pad 4 has two protruding portions 41, 42 which are protruded from both end portions 31*a*, 31*b* in the reciprocating directions A1 and A2 of the first cleaning pad 31. However, it is possible to provide the second cleaning pad 4 in such a manner that the second cleaning pad 4 has only the protruding portion 41 which is protruded from the front end portion 31*a* in the going-back movement of the first cleaning pad 31.

In the cleaning device 1 of the first exemplary embodiment, the width (W3) of the first cleaning pad 31 is wider than that of the second cleaning pad 4 and both end portions of the first cleaning pad 31 in the direction B perpendicular to the discharge wire 23 stretching direction A are protruded from both end portions in the perpendicular direction B of the second cleaning pad 4. However, it is possible to arrange the first cleaning pad 31 in such a manner that it is protruded only from one end portion in the perpendicular direction B of the second cleaning pad 4. This cleaning device 1 can be applied to a case in which wires except for the discharge wire 23 are cleaned.

In the cleaning device 1 of the first exemplary embodiment, the first cleaning pad 31 is formed out of two cleaning pads 31, 32. However, it is possible to compose the device in such a manner that the other cleaning pad 32 is not provided but only one cleaning pad 31 is provided on the side being contacted with the second cleaning pad 4. Concerning the first cleaning pad 31, the first cleaning pad 31 can include three or more cleaning pads. However, in this case, three or more cleaning pads are arranged at intervals (S) in the discharge wire 23 stretching direction A at positions on the opposite side with respect to the discharge wire 23 and the second cleaning pad 4 is arranged being contacted with the cleaning pad, which is the rear end pad at the time of the going-back movement in the three or more pads while the discharge wire 23 is being interposed between the first and the second cleaning pad. In the case where the first cleaning pad 31 is formed out of a plurality of cleaning pads, it is effective that the second cleaning pads 4 are arranged so that they can be contacted with two or more cleaning pads 31 in the plurality of the first cleaning pads while the discharge wire 23 is being interposed between the first and the second cleaning pads.

The charging device 2 can be a so-called corotron type charging device in which the grid electrode 24 is not provided. For example, in the corotron type charging device, a body to be electrically charged except for the photoreceptor drum can be electrically charged. The corotron type charging device may be applied to a transfer device or a peeling device in which the corona discharge is used.

The image forming apparatus 100 can be composed in such a manner that a plurality of image forming units 102 are used so as to form toner images of different colors. In this case, a toner image formed on a circumferential face of the photoreceptor drum of each image forming unit 102 is transferred onto a belt-shaped or a drum-shaped intermediate transfer body which is arranged continuously passing through a transfer position between the photoreceptor drum and the transfer device. After that, the toner images formed by the image forming devices are transferred from the intermediate transfer body onto a sheet of paper all together. Further, the toner image can be transferred onto a sheet of paper conveyed by a belt-shaped or drum-shaped sheet conveying transfer body arranged so that it can continuously pass through the transfer position of the image forming unit 102. Except for the above case, it is possible to apply to a case in which a plurality of developing units are provided which can respectively develop a toner image of a different color as one image forming unit 102 and a plurality of toner images of different colors are successively formed on one photoreceptor drum.

In the exemplary embodiment described above, explanations are made into a case in which the charging device is used for an image forming apparatus. However, it is possible to apply the invention to a charging device used for sticking a protective film onto a surface of a metallic plate. Further, it is possible to apply the invention to a discharging device used for electrically discharging a protective member by using the corona discharge at the time of winding the thin-film-shaped protective member round a component or a device.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device of a wire comprising:

a first cleaning member that cleans the wire when the first cleaning member comes into contact with the wire;

a second cleaning member that wipes off the wire when the second cleaning member comes into contact with the first cleaning member while the wire is being interposed between the first and the second cleaning member; and a holding and moving body that holds and reciprocates the first and the second cleaning members in a first direction in which the wire is stretched, wherein the second cleaning member is contacted with the wire at a protruding portion in which the second cleaning member protrudes beyond a rear end portion of the first cleaning member in the first direction at least at the time of a going-back movement of the first cleaning member.

2. The cleaning device of the wire according to claim 1, wherein a size of the protruding portion is set such that it is at a ratio not less than 20% of a size of a portion in which the second cleaning member comes into contact with the wire.

3. The cleaning device of the wire according to claim 1, wherein a width of the first cleaning member in a second direction perpendicular to the first direction in which the wire is stretched is wider than a width of the second cleaning member in the direction perpendicular to the direction in which the wire is stretched, and the first cleaning member extends in the second direction and in opposite thereof beyond edges of the second cleaning member.

4. The cleaning device of the wire according to claim 1, wherein the first cleaning member is made of material containing abrasive material, and the second cleaning member is made of porous elastic material, the percentage of voids of which is not less than 90%.

5. The cleaning device of the wire according to claim 1, wherein the hardness of the second cleaning member is lower than the hardness of the first cleaning member and the second cleaning member is maintained being pushed and pressurized by the first cleaning member.

6. The cleaning device of a wire according to claim 1, wherein an accommodating portion for accommodating adhering objects which is removed from the wire, is provided in a portion of the holding and moving body for holding at least the second cleaning member.

7. The cleaning device of a wire according to claim 1, wherein the first cleaning member includes a plurality of members arranged at positions on the opposite side to each other with respect to the wire in such a manner that the plurality of members are located being shifted from each other at intervals in the direction in which the wire is stretched, and the second cleaning member is contacted with at least the most rear member of the first cleaning member at the time of the going-back movement of the first cleaning members, while the wire is being interposed between the first cleaning member and the second cleaning member.

8. A charging device comprising:

a wire that is provided being stretched while an interval between the wire and a surface of a body to be charged is formed, voltage for charging being applied between the wire and the body to be charged; and a cleaning device that cleans the wire in such a manner that after first and second cleaning members are moved from a waiting and stopping position in a direction in which the wire is stretched, the first and second cleaning members turns back to the waiting and stopping position, the cleaning device that includes:

a first cleaning member that cleans the wire when the first cleaning member comes into contact with the wire;

a second cleaning member that wipes off the wire when the second cleaning member comes into contact with the first cleaning member while the wire is being interposed between the first cleaning member and the second cleaning member; and a holding and moving body that (i) holds the first and the second cleaning member at the waiting and holding position in a state in which the first and the second cleaning member are separate from each other, (ii) holds the first and the second cleaning members in a state in which the first and the second cleaning members are contacted with each other when the first and the second cleaning members move from the waiting and the stopping position and (iii) reciprocates the first and the second cleaning members in the direction in which the wire is stretched, wherein the second cleaning member contacts with the wire at a protruding portion in which the second cleaning member extends beyond at least an end portion of the first cleaning member on the opposite side to the waiting and stopping position.

9. An image forming apparatus comprising:

the charging device according to claim 8; and an image forming unit that has an image holding body to be charged by the charging device.

* * * * *